US005423625A

United States Patent [19]

Gebauer et al.

[11] Patent Number: 5,423,625

[45] Date of Patent: Jun. 13, 1995

[54] BOOM/ARM COUPLER FOR EXCAVATOR

[75] Inventors: Thomas E. Gebauer; Leroy E. Kraske, both of Dubuque, Iowa

[73] Assignee: JRB Company, Inc., Akron, Ohio

[21] Appl. No.: 49,609

[22] Filed: Apr. 16, 1993

Related U.S. Application Data

[63] Continuation of Ser. No. 743,257, Aug. 9, 1991, abandoned.

[51] Int. Cl.[6] ..... F16D 1/06

[52] U.S. Cl. ..... 403/322; 414/723; 37/468

[58] Field of Search ..... 414/723, 686, 694; 172/272-275; 403/322, 325; 37/468

[56] References Cited

U.S. PATENT DOCUMENTS 3,149,737 9/1964 Guinot ..... 414/694
4,295,287 10/1981 Natzke et al. ..... 414/723 X
4,366,967 1/1983 Vollmer et al. ..... 172/272 X
4,775,287 10/1988 Hering, Sr. ..... 414/694
4,938,651 7/1990 Gilmor et al. ..... 414/723 X
5,050,684 9/1991 Vollmer ..... 172/272

*Primary Examiner*—Donald W. Underwood
*Attorney, Agent, or Firm*—Renner, Kenner, Greive, Bobak, Taylor & Weber

[57] ABSTRACT

A coupler is provided for implementation on the boom of an excavator and adapted for receiving and coupling an arm or implement. The coupler is pinned to the boom through apertures and a pair of parallel plates. An actuating hydraulic piston is connected to the coupler through holes passing through another pair of plates. Attachment to the arm or implement is achieved by first engagement of a pair of slots with pins on the arm, and subsequent engagement of other slots with another pair of pins. The last mentioned slots have associated therewith a cam locking plate which closes the slot upon the pins to prevent removal.

6 Claims, 1 Drawing Sheet

BOOM/ARM COUPLER FOR EXCAVATOR

This is a continuation of application Ser. No. 07/743,257, filed Aug. 9, 1991, now abandoned.

TECHNICAL FIELD

The invention herein resides in the art of coupling devices and, more particularly, to implement couplers for heavy equipment. Specifically, the invention relates to a coupler adapted for receipt upon the boom of an excavator to receive various arms and implements.

BACKGROUND ART

Excavators or "power shovels" have been well known and widely used in various industries. Typically, such excavators include a boom extending from a center base member of the excavator to an upwardly and outwardly extending end at which an arm or implement is attached. Those skilled in the art often refer to such arm as a "dipper stick."

In the construction industry, a shovel or bucket is most commonly maintained at the end of the dipper stick for removing and depositing earth. Other industries such as the material handling industry employs shears, grapples, magnets, and other such devices at the end of the arm or dipper stick, or as an independent implement maintained at the end of the boom itself. Specifically, the demolition and scrap processing fields employ such devices in routine operation.

Regardless of the type of arm or implement employed at the end of the boom, it will be understood by those skilled in the art that an excavator employs hydraulic pistons and the like for raising and lowering the boom, moving the arm or implement with respect to the boom, and for actually operating the implement attached to the end of the boom or the end of the arm. The concept of the invention presented herein is readily adaptable to implementation with excavators of the types generally described.

To improve the utility and versatility of excavators, it is most desirable that various implements and/or arms may be quickly and reliably coupled to the boom. In other words, a single excavator can be employed at one point in time with shears, at a subsequent point in time with a grapple, at another point with a magnet, and at a still different point with a bucket. However, the implements and arms used in association with excavators are of extreme size, often being 15–20 feet in length, and weighing hundreds of pounds. Those skilled in the art readily recognize that such arms and implements are difficult to maneuver and position.

Previously, the changing of implements or arms at the end of the boom of an excavator has been time consuming, difficult, labor intensive, and dangerous. Such operation necessarily requires removal and replacement of multiple pins to achieve the desired engagement. The removal and placement of such pins could, however, only be undertaken after manually and hydraulically manipulating the heavy and cumbersome boom and arm.

There is a need in the art for a coupler to accommodate quick release and attachment between the boom and arm or implement to be utilized with an excavator.

DISCLOSURE OF INVENTION

In light of the foregoing, it is a first aspect of the invention to provide a coupler for an excavator which allows for rapid and effective connection and detachment of an arm or implement with the boom of the excavator.

Another aspect of the invention is the provision of a coupler for an excavator which maintains the integrity of the boom and the coupled arm or implement to maintain operational efficiency.

Still a further aspect of the invention is the provision of a coupler for an excavator which is reliable and durable in operation.

Yet another aspect of the invention is the provision of a coupler for an excavator which is readily adapted to implementation with state of the art excavators, booms, arms, and implements.

The foregoing and other aspects of the invention which will become apparent as the detailed description proceeds are achieved by a coupler for interconnection between the boom, arm, and hydraulic piston intended for interconnection between the boom and arm of an excavator, comprising: a first pair of plates having first means at a first end thereof for engaging the boom, and second means at a second end thereof for engaging the arm; a second pair of plates, one connected to each of said first pair of plates at said first ends thereof, each of said second pair of plates having third means for engaging the arm; and a third pair of plates, one connected to each of said first pair of plates at said second ends thereof, each of said third pair of plates having fourth means for engaging the hydraulic piston.

Other aspects of the invention which will become apparent herein are attained by a coupler for interposition between the boom, arm, and hydraulic piston intended for interconnection between the boom and arm of an excavator, comprising: a first pair of parallel interconnected plates, each of said first pair of plates having an annular opening in a first end thereof for receiving a pin for interconnection with the boom, and a slot in a second end thereof for receiving a pin for interconnection with the arm; a second pair of parallel interconnected plates connected to and extending from said first pair of plates, each of said second pair of plates having a slot passing therethrough for receiving a pin for interconnection with the arm; and a third pair of parallel interconnected plates connected to and extending from said first pair of plates, each of said third pair of plates having an annular opening therein for receiving a pin for interconnection with the hydraulic piston.

DESCRIPTION OF THE DRAWINGS

For a complete understanding of the objects, techniques and structure of the invention reference should be made to the following detailed description and accompanying drawings wherein.

BEST MODE FOR CARRYING OUT THE INVENTION

Figure 1:
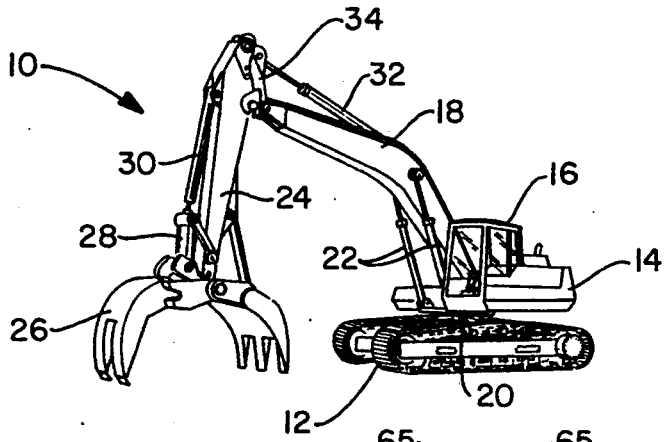
FIG. 1 is an illustrative view of an excavator employing the coupler of the invention.

Referring now to the drawings and more particularly FIG. 1, it can be seen that an excavator of the type well known in the industry is designated generally by the numeral 10. The excavator 10 is movable upon tractor or roller chain treads 12 in standard fashion. An engine or power unit 14 such as a diesel engine or the like is operative to drive the treads 12 and the various hydraulic pumps, generators, and systems employed in the operation of the excavator. A cab 16 is maintained upon a base 20 for accommodating an operator controlling the excavator 10.

In standard fashion, a boom 18 extends upwardly from the base 20 and is movable in elevation by means of hydraulic pistons 22. At the end of the boom 18 an arm or dipper stick 24 is appropriately attached. It will be appreciated by those skilled in the art that the arm 24 may be replaced by a unitary implement as well known to those skilled in the art. In the embodiment shown, a bucket or other appropriate implement 26 is maintained at the end of the arm 24. An appropriate linkage 28 is interconnected between the hydraulic piston and the bucket 26 to control the operation of the bucket in a fashion well known and understood by those skilled in the art. In similar fashion, a hydraulic piston 32 is interposed between the boom 18 and arm 24 for achieving pivotal movement between those two members, again in a fashion well known and understood in the art. Unlike the prior art, a coupler 34 is interposed between the boom 18, hydraulic piston 32, and arm 24.

Figure 2:
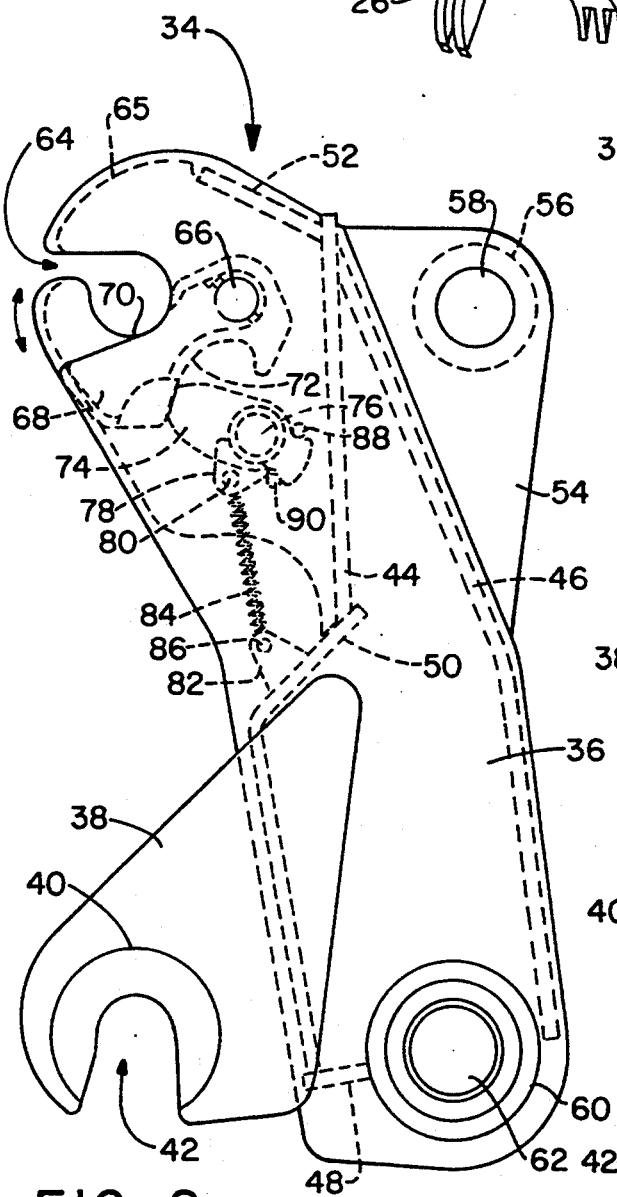
FIG. 2 is a side elevational view of the coupler of the invention, showing the coupler in depth by the implementation of phantom lines.
Figure 3:
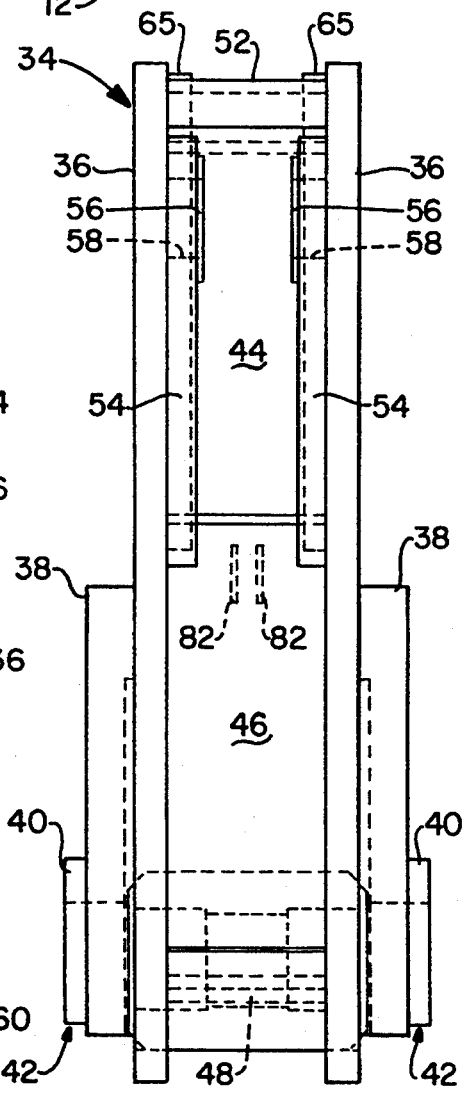
FIG. 3 is a rear elevational view of the coupler of FIG. 2.

With reference now to FIGS. 2 and 3, the detailed structure of the coupler 34 can be appreciated. As shown, a pair of side plates 36 are maintained in parallel spaced apart relationship to form a channel member. Gusset plates 38 are welded or otherwise appropriately attached to each of the side plates, 36 as shown. A boss 40 is formed on or otherwise attached to each of the gusset plates 38 and surrounding a slotted opening 42.

Interconnecting the pair of side plates 36 and providing rigidity and strength to the coupler 34, are an inner plate 44, a back plate 46, a bottom plate 48, a front plate 50, and a top plate 52. All of the plates described are typically of metal construction and interconnected to the respective side plates 36 by means of weldments or other appropriate means.

A pair of flange plates 54 are connected to and extend from respective side plates 36 and the back plate 46, again being attached by means of weldments or other appropriate means. A boss 56 is provided about an annular opening or hole 58 in each of the flange plates 54, as shown.

At the bottom of each of the side plates 36, a boss 60 is also provided about an annular opening or hole 62. At the opposite end of the side plates 36, a slotted opening 64 is provided, such slot extending from interior of the plate 36 outwardly through a peripheral edge thereof. It will be appreciated by those skilled in the art that a gusset plate 65 may, if desired, be welded to the inner surface of each of the side plates 36 in the area of the slots 64 to provide strength and reinforcement.

A pivot pin 66 is connected to each of the side plates 36 to pivotally receive a cam locking plate 68. As shown, the cam locking plate 68 has an arcuate lip 70. When the cam locking plate 68 is pivoted about the pin 66 to bring the arcuate lip 70 into the area of the slot 64, the arcuate lip 70 serves to partially close the slot 64 to effectively change the slot into a substantially circular opening. The purpose of this locking action will become apparent below.

A cam surface 72 on the back side of the cam locking plate 68 is adapted for engagement with a cam 74 mounted upon and pivotal about the pivot pin 76. It will be appreciated that in a preferred embodiment of the invention, each of the side plates 36 receives a cam locking plate 68 and associated cam 74 as just described. A cam biasing member 78 is received upon a pin 80 connected to the associated side plate 36. Appropriate mounting flanges 82 are received upon the front plate 50 and positioned in alignment with associated cam biasing members 78 as shown. A spring 84 is interposed between the pin 86 of the mounting flange 82 and the biasing member 78 to load the biasing member 78 against the cam 74 to minimize unwanted movement of the cam.

A stop pin 88 is provided within the side plate 36 and/or gusset plate 65, to limit movement of the cam 74. A spring-biased locking pin 90 is also provided in association with the cam 74 to lock the cam 74 into a preset position when desired. The locking pin 90 may, however, be easily disengaged from an associated hole for moving the cam 74 and allowing the cam locking plate 68 to move from interference with the slotted opening 64 when desired.

In operation, the coupler 34 would typically be fixedly secured to the boom 18 of the excavator 10. Pins would pass through the openings 62 and the boom 18 to achieve the desired interengagement. In like manner, the annular opening 58 would receive pins from the hydraulic piston 32 which is connected at the other end to the boom 18. When it is desired to engage an arm or an implement to the boom 18 through the coupler 34, the slotted openings 42 are brought down upon pins appropriately extending from the arm or implement such as the arm 24. With the locking pin 90 disengaged and the cam 74 moved upon the cam surface 72 such that the cam locking plate 68 is removed from the slotted opening 64, another pair of pins of the arm 24 may be received within the slots 64. This engagement can readily be made by simple manipulation of the hydraulic piston 32 to rock the slot 64 upon such pins as will be readily appreciated by those skilled in the art. With the pins received within the slots 64, the cam locking plates 68 can be moved to wrap around the respectively associated pins, causing slot 64 to take on a substantially circular geometry which is substantially congruent with the pin so received. At this point in time, the cam 74 may be moved down to its locking position as shown in the drawings, at which time the locking pin 90 engages a securing hole within either or both of the associated plates 36, 65. At such point in time, the implement or arm is securedly engaged through the coupler 34 to the boom of the excavator.

It will readily be appreciated that removal of the implement or arm may be undertaken in the reverse operation discussed above. Disengagement of the locking pin 90 and rotation of the cam 74 upon the cam surface 72 will allow the cam locking plate 68 to move from its interference with the slot 64, allowing the pins of the arm 24 to be removed. The other pins of the arm may be similarly disengaged by simply lifting the coupler 34 such that the pins slide out of the openings 42.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A coupler for interconnection between a boom, arm, and hydraulic piston intended for interconnection between a boom and arm of an excavator, comprising:

a first pair of plates having first means at a first end thereof for engaging the boom, and second means at a second end thereof for engaging the arm, said second means comprising a slot in each of said first pair of plates, said slot passing through said plate and extending through a peripheral edge thereof and adapted for receipt of a first pin carried by the arm, a cam locking plate pivotally maintained adjacent said slot in each of said first pair of plates, said cam locking plate having an arcuate surface adapted for selective interposition within said associated slot, said arcuate surface substantially annularizing said associated slot, and a cam in engagement with a cam surface of said cam locking plate, movement of said cam urging said arcuate surface into said associated slot;

a second pair of plates, one connected to each of said first pair of plates at said first ends thereof, each of said second pair of plates having third means for engaging the arm; and a third pair of plates, one connected to each of said first pair of plates at said second ends thereof, each of said third pair of plates having fourth means for engaging the hydraulic piston.

2. The coupler according to claim 1, wherein said first means comprises an annular opening in each of said first pair of plates, said annular openings adapted to receive a pin for interconnection with the boom.

3. The coupler according to claim 2, wherein said fourth means comprises an annular opening in each of said third pair of plates, said annular openings adapted to receive a pin for interconnection with the hydraulic piston.

4. The coupler according to claim 3, wherein said third means comprises a slot in each of said second pair of plates, said slot passing through said plate and extending through a peripheral edge thereof and being adapted for receipt by a first pin carried by the arm.

5. The coupler according to claim 1, further comprising locking means interconnected with said cam for locking said cam in a selected position.

6. A coupler for interposition between a boom, arm, and hydraulic piston intended for interconnection between a boom and arm of an excavator, comprising:

a first pair of parallel interconnected plates, each of said first pair of plates having an annular opening in a first end thereof for receiving a pin for interconnection with the boom, and a slot in a second end thereof for receiving a pin for interconnection with the arm;

a second pair of parallel interconnected plates connected to and extending from said first pair of plates, each of said second plates having a slot passing therethrough for receiving a pin for interconnection with the arm;

a third pair of parallel interconnected plates connected to and extending from said first pair of plates, each of said third pair of plates having an annular opening therein for receiving a pin for interconnection with the hydraulic piston; and locking means in association with each of said slots in said second end of each of said first pair of plates for retaining the pin received within the associated slot, said locking means comprising a cam lock pivotally connected to each of said first pair of plates and having an arcuate surface adapted for making selective interengagement with said associated slot, and a cam in engagement with a cam surface of said cam lock.

* * * * *